US006016926A

United States Patent [19]

Smith, II et al.

[11] Patent Number: 6,016,926

[45] Date of Patent: Jan. 25, 2000

[54] INFANT BATH TOY MOUNTING DEVICE

[75] Inventors: Donald A. Smith, II, Harrisville; Celeste T. Penacho, Cumberland, both of R.I.

[73] Assignee: Summer Infant Products, Inc., Cumberland, R.I.

[21] Appl. No.: 09/162,488

[22] Filed: Sep. 28, 1998

Related U.S. Application Data

[63] Continuation of application No. 29/082,698, Nov. 25, 1997, Pat. No. Des. 403,719.

[51] Int. Cl.[7] ..... A47F 5/00; A63H 33/00

[52] U.S. Cl. ..... 211/119.011; 211/123; 211/118; 248/206.3; 446/227; D21/476

[58] Field of Search ..... 211/119.011, 123, 211/105.2, 118; 248/206.3; D21/476, 475; 446/227; D6/524

[56] References Cited

U.S. PATENT DOCUMENTS

| | | | |
|---|---|---|---|
| D. 169,246 | 4/1953 | Eisenberg . | |
| D. 275,974 | 10/1984 | Rivollet . | |
| D. 295,198 | 4/1988 | Williams et al. . | |
| D. 316,573 | 4/1991 | Finiw et al. . | |
| D. 317,333 | 6/1991 | Thomson et al. . | |
| 355,663 | 1/1887 | Price . | |
| D. 374,692 | 10/1996 | Stroud et al. . | |
| D. 403,719 | 1/1999 | Smith et al. | D21/476 |
| 1,172,937 | 2/1916 | Butcher . | |
| 2,282,881 | 5/1942 | Ostrow | 446/227 |
| 2,402,861 | 6/1946 | Winnick . | |
| 2,639,816 | 5/1953 | Fogg | 211/119.011 |
| 3,876,080 | 4/1975 | Hultberg et al. . | |
| 3,978,610 | 9/1976 | Stubbmann . | |
| 4,188,745 | 2/1980 | Harvey et al. . | |
| 4,664,640 | 5/1987 | Shindo et al. | 446/227 |
| 5,702,039 | 12/1997 | Olaiz | 446/227 X |

*Primary Examiner*—Robert W. Gibson, Jr.
*Attorney, Agent, or Firm*—John E. Reilly

[57] ABSTRACT

A bath toy mounting device adapted to be releasably secured to the side or bottom wall of a bathtub partially filled with water. The bath toy mounting device maintains a secure attachment to the bathtub but may be easily removed by an adult. The bath toy mounting device further includes a toy holding device, such as elongated bar, for suspending toys above the water. Toys are secured to and hang from the toy holding device by means of a coupling member. In this way, the coupling member allows the child to move the toys while restricting movement to the immediate vicinity of the toy holding device. Additionally, the bath toy mounting device insures that toys are readily accessible to the child while he or she takes a bath.

26 Claims, 2 Drawing Sheets

INFANT BATH TOY MOUNTING DEVICE

CROSS-REFERENCE TO RELATED APPLICATIONS

This application is a continuation of patent application Ser. No. 29/082,698 filed Nov. 25, 1997 now U.S. Design Pat. No. D403,719, for INFANT BATH TOY (Design) by Donald A. Smith, II and Celeste T. Penacho.

BACKGROUND AND FIELD OF THE INVENTION

It is well known that children love to play with toys while they take a bath. Typical bathtub toys float freely through the water and often escape a child's reach. The use of these toys places a child in danger when the child moves around the bathtub in search of the toy. Also, children often throw toys out of the bathtub making retrieval difficult.

It is therefore desirable to provide a mounting device which will hold bathtub toys in fixed location while still permitting children to play with the toy. It is also desirable to provide a bath toy mounting device which may be easily adjusted, or can be removed when not in use or when an adult wishes to use the bathtub.

SUMMARY OF THE INVENTION

It is therefore an object of the present invention to provide for a novel and improved bath toy mounting device which has a toy holder extending above the water for suspending toys so as to be readily accessible to a child sitting in the tub.

It is another object of the present invention to provide a novel and improved bath toy mounting device adapted to be releasably secured to the side or bottom wall of a bathtub partially filled with water.

In accordance with the present invention, an infant bath toy mounting device is formed by connecting means for releasable attachment to a bathtub with a toy holding device, such as, an elongated bar. The toy holding device terminates in at least two ends and attachment means are connected to both ends of the toy holding device. Toys are secured to and hang from the toy holding device by means of a coupling member. In this way, the coupling member allows the child to move the toys while restricting movement to the immediate vicinity of the of the toy holding device. Additionally, the bathtub toys are readily accessible to the child while he or she takes a bath.

In the second function, the attachment means comprises one or more suction cups affixed to the toy holding device. For example, a pair of suction cups may be attached to an end cap located on each end of the toy holding device. This type of attachment means creates a secure attachment to a bathtub while also providing easy adjustment or removal if an adult wishes to use the bathtub.

The above and other objects of the present invention will become more readily appreciated and understood from a consideration of the following detailed description of preferred and modified forms of the present invention when taken together with the accompanying drawings in which:

DETAILED DESCRIPTION OF A PREFERRED EMBODIMENT

Referring in more detail to the drawings, as shown in FIGS. 1–5, a preferred embodiment of the present invention is described. In this particular preferred embodiment an infant bath toy mounting device is illustrated. It is to be clearly understood that this preferred embodiment is provided for descriptive purposes only and is not meant to unduly limit the scope of the inventive concept. Other embodiments are included within the inventive concept as set forth.

Figure 1:
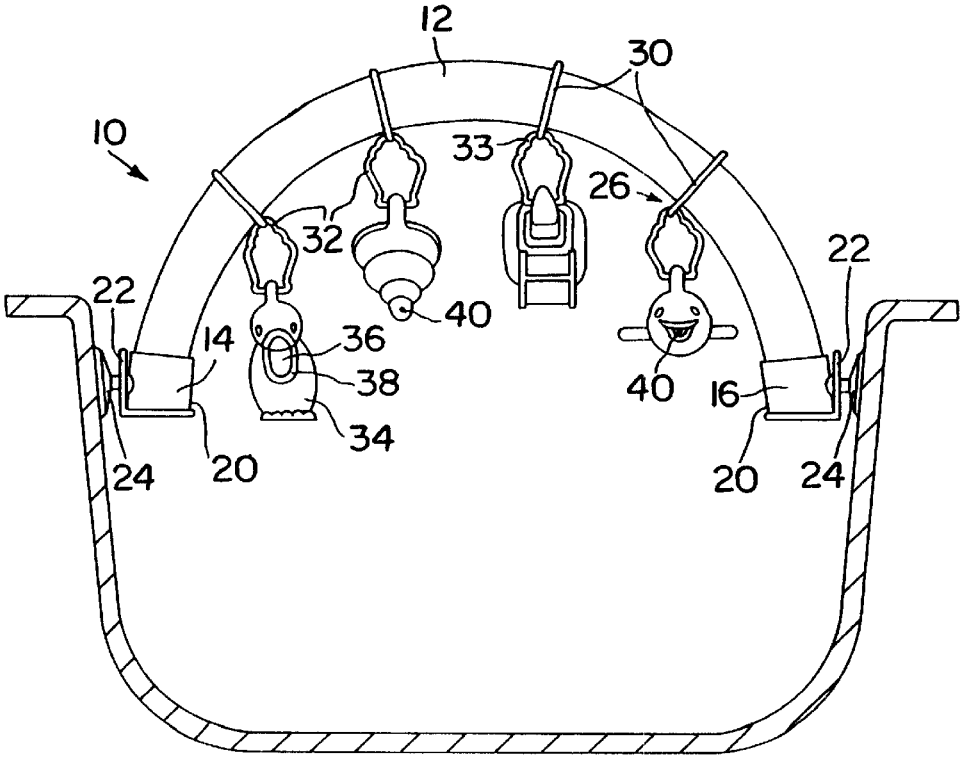
FIG. 1 is a front view of a preferred form illustrating an infant bath toy mounting device mounted on opposite side walls of a bathtub.
Figure 3:
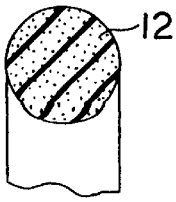
FIG. 3 is a cross-sectional view along lines 3—3 of FIG. 2.

The infant bath toy mounting device 10, as shown in FIG. 1, is intended for use in a bathtub B partially filled with water. The infant bath toy mounting device 10 includes an elongated bar 12 for holding toys. The elongated bar 12 terminates in a first end 14 and a second end 16. The elongated bar 12 may be composed of a pliable or flexible material such as a cellular foam. The elongated bar 12 is of a generally circular cross-sectional configuration as shown in FIG. 3. However, it is to be clearly understood that other variables may be used. For example, the elongated bar 12 may be of a square, rectangular, triangular, or other shaped cross-sectional configuration. The body of the elongated bar 12 may be solid or hollow and may be rigid or flexible. Many different materials may be used for the elongated bar 12 such as rubber, plastic, or sponge.

Figure 2:
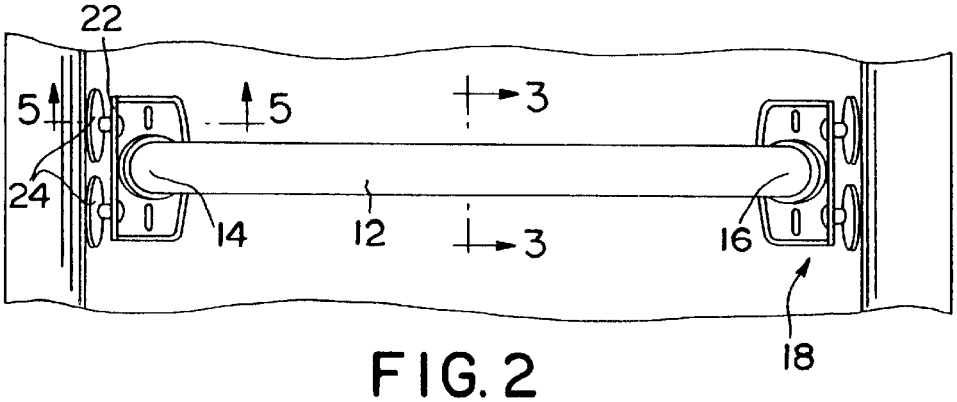
FIG. 2 is a top view of the device of the invention as shown in FIG. 1.
Figure 4:
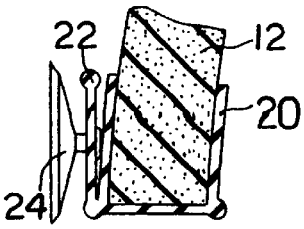
FIG. 4 is a cutaway view along line 4 of FIG. 2.

The infant bath toy mounting device 10 further includes attachment means 18 for nonpermanent attachment to a bathtub. The attachment means 18 has an end cap 20 covering each of the ends 14 and 16 of the elongated bar 12 as shown in FIG. 4. Each end cap 20 has a flat protrusion 22 on one side of and parallel to the longitudinal axis of the elongated bar 12. The attachment means 18 further includes a pair of suction cups 24 in juxtaposed relation to one another and affixed to the flat protrusion 22 of each end cap 20 for releasable attachment to a bathtub as shown in FIG. 2. This type of temporary attachment is more than strong enough to securely hold the infant bath toy mounting device 10 while the child uses it, but also permits quick and easy adjustment or removal by an adult. It is to be understood that any other embodiment of the attachment means 18 which provides secure but temporary attachment may be used.

Figure 5:
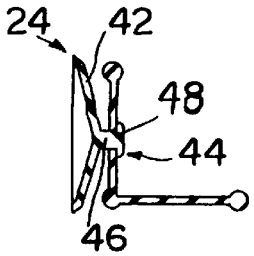
FIG. 5 is a cross-sectional view along line 5 of FIG. 2.

Each suction cup 24 is permanently affixed to the flat protrusion 22 as shown in FIG. 5. Each suction cup 24 has a resilient concave portion 42 and a stem 44 protruding from the center of and in the opposite direction of the concave portion 42. The stem 44 has a middle portion 46 and an end portion 48. The middle portion 46 has a diameter which is less than the diameter of a hole 23 in the flat protrusion 22, and the middle portion 46 extends through the hole 23. The end portion 48 of the stem 44 is located on the opposite side of the flat protrusion 22 from the concave portion 42. The end portion has a diameter which is larger than the diameter of the hole 23 thereby permanently connecting the suction cup 24 to the end cap 20. It is to understood that other means of permanent affixation of the suction cup 24 to the elongated bar 12 may be used. For example, the suction cup 24 may be glued to the end cap 20 or directly affixed to the elongated bar 12.

Figure 8:
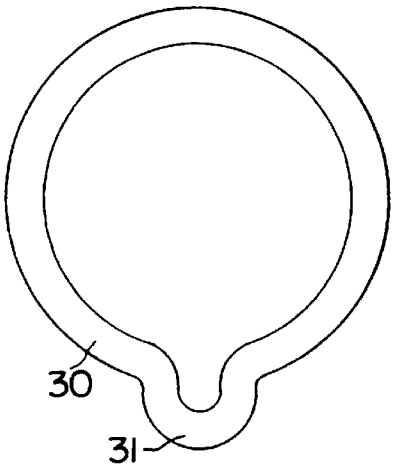
FIG. 8 is a front view of the suspension member 32.

At least one coupling member 26 secures one or more objects, such as a toy 28, to the elongated bar 12. The coupling member 26 includes a connecting ring 30 as shown in FIG. 8. The connecting ring 30 is directly attached in surrounding relation to the elongated bar 12 as shown in FIG. 1. The plane of the connecting ring 30 is generally perpendicular to the longitudinal axis of the elongated bar 12. The connecting ring 30 has a notch 31 which extends away from the elongated bar 12. The inner diameter of the connecting ring 30 is less than the outer diameter of the elongated bar 12 which constrains any movement of the connecting ring 30 along the elongated bar 12. Movement of the connecting ring 30 along the elongated bar 12 is still possible when the pliable material of the elongated bar 12 is compressed.

Figure 7:
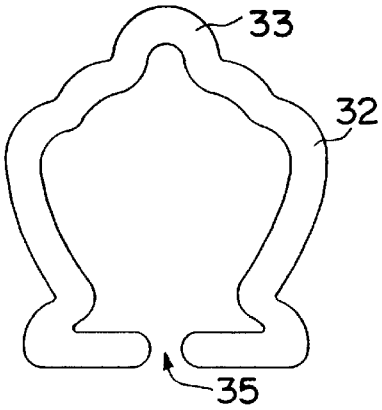
FIG. 7 is a top view of the device of the invention along line 7 of FIG. 6.

The coupling member 26 further includes a suspension member 32 having a complementary notch 33 as shown in FIG. 7. The complementary notch 33 connects to the notch 31 in the connecting ring 30. The plane of suspension member 32 is generally perpendicular to the plane of the connecting ring 30 and generally parallel to the longitudinal axis of the elongated bar 12. The suspension member 32 has a gap 35 for releasable attachment of the suspension member 32 to the toy 28. In this way, the toy 28 swings freely while remaining connected to the elongated bar 12 via the coupling member 26, giving the child easy access to the toy 28.

Figure 6:
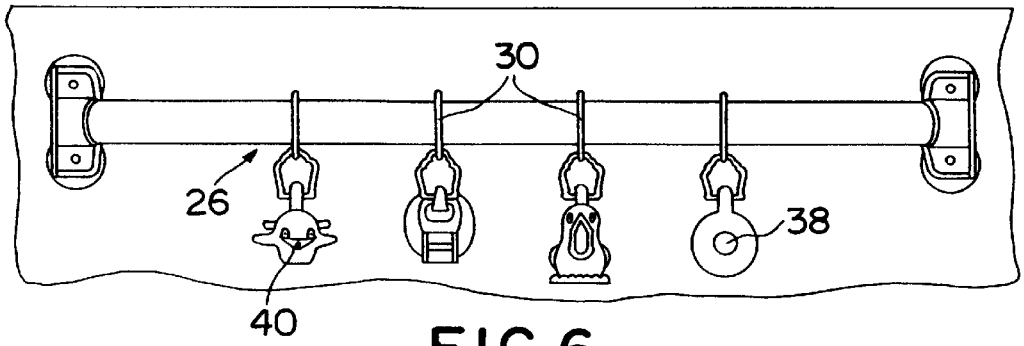
FIG. 6 is a front view illustrating the preferred infant bath toy mounting device mounted on one side wall of the bathtub.

A particularly inventive feature of the present invention is the ability to change the way the infant bath toy mounting device 10 is attached to a bathtub. The first way the infant bath toy mounting device 10 may be attached is by affixing the attachment means 18 of the first end 14 to the opposite wall of the bathtub from the attachment means 18 of the second end 16, as shown in FIGS. 1 and 2. This type of attachment causes the elongated bar 12 to form a convex or inverted U-shaped configuration thereby making room for the child to sit partially beneath the infant bath toy mounting device 10. The second way the infant bath toy mounting device 10 may be attached is by affixing the attachment means 18 of both the first end 14 and the second end 16 to the same wall of the bathtub, as shown in FIGS. 6 and 7. This type of attachment causes the elongated bar 12 to form a linear configuration which uses less bathtub space while still providing easy access to the toy 28. Moreover, the infant bath toy mounting device 10 may be attached to any flat surface and in many different locations such as tile walls surrounding a bathtub or shower area, walls of a sink, play pen, or crib.

Figure 9:
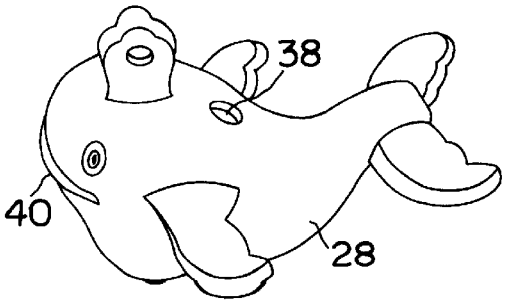
FIG. 9 is a front view of the connecting ring 30.

Another inventive feature of the infant bath toy mounting device 10 is the various ways a child may use the toy 28 to manipulate water. In a first embodiment, the toy 28 is composed of a hollow body 34 forming a cavity 36. The child may fill the cavity 36 of toy 28 with water through an opening 38 in the hollow body 34 as shown in FIG. 9. In another embodiment of the toy 28, the hollow body 34 forms at least one additional opening 40 for discharge of the water in cavity 36. The water may be discharged either by gravity or when the child squeezes the hollow body 34 of the toy 28; each way provides entertainment for a child during a bath.

It is therefore to be understood that the above and other modifications and changes may be made in the toy mounting device of the present invention without departing from the spirit and scope of the invention as defined by the appended claims.

I claim:

1. A bath toy mounting device comprising:

an elongated bar of generally circular cross-sectional configuration terminating in a first and second end, said elongated bar composed of a pliable material, an end cap of generally cup-shaped configuration receiving each of said first and second ends of said elongated bar, each said end cap having a flat protrusion on one side of and parallel to the longitudinal axis of said elongated bar, a pair of suction cups in juxtaposed relation to one another affixed to said flat protrusion of each of said end caps for releasable attachment to a bathtub, at least one connecting ring affixed in surrounding relation to said elongated bar, said connecting ring having a notch extending away from said elongated bar, said connecting ring having an inner diameter less than the outer diameter of said elongated bar thereby constraining any movement of said connecting ring along said elongated bar unless said pliable material of said elongated bar is compressed, a suspension member having a complementary notch to said notch in said connecting ring, said complementary notch in said suspension member connected to said notch in said connecting ring such that said suspension member occupies a plane perpendicular to the plane occupied by said connecting ring, and a toy object suspended from said suspension member such that said object freely hangs from said elongated bar, said suspension member having a gap opposite said complementary notch in said suspension member, said gap permitting removal of said toy object from said suspension member.

2. The bath toy mounting device of claim 1 wherein:

said elongated bar is of a generally convex or inverted U-shaped configuration.

3. The bath toy mounting device of claim 1 wherein:

said elongated bar is of a generally linear shaped configuration.

4. The bath toy mounting device of claim 1 further including:

mounting means for permanent attachment of said suction cup to said flat protrusion, said suction cup having a concave portion and a stem protruding from the center of and in an opposite direction of said concave portion of said suction cup, said stem having a middle portion and an end portion, said middle portion having a diameter less than the diameter of a hole in said flat protrusion of said end cap, said middle portion of said stem extending through said hole in said flat protrusion, said end portion located on the opposite side of said flat protrusion from said concave portion, said end portion having a diameter more than the diameter of said hole thereby forming a permanent attachment of said suction cup to said flat protrusion.

5. The bath toy mounting device of claim 1 wherein:

said suspension member is of a generally ring shaped configuration.

6. The bath toy mounting device of claim 1 wherein:

said suspension member is of an irregular, step-shape configuration.

7. The bath toy mounting device of claim 1 wherein:

said toy object is composed of flexible material.

8. The bath toy mounting device of claim 1 wherein:

said toy object is composed of rigid material.

9. The bath toy mounting device of claim 1 wherein:

said toy object comprises a hollow body forming a cavity for holding water therein and wherein water fills said cavity through an opening in said hollow body.

10. The bath toy mounting device of claim 8 wherein:

said hollow body has at least one additional opening therein for discharging water from said hollow body.

11. A toy mounting device comprising:

a toy holding device in the form of an elongated bar terminating in a first and second end, attachment means affixed to each of said first and second ends for releasable attachment to a flat surface, at least one coupling member securing to said toy holding device, including a connecting ring affixed in surrounding relation and perpendicular to the longitudinal axis of said elongated bar, an object, and a suspension ring affixed to said connecting ring for suspending said object from said elongated bar.

12. The toy mounting device of claim 11 wherein:

said elongated bar is of a generally inverted U-shaped configuration.

13. The toy mounting device of claim 11 wherein:

said elongated bar is of a generally linear configuration.

14. The toy mounting device of claim 11 wherein:

said elongated bar consists of a flexible material for changing the shape of said elongated bar from an inverted U-shaped configuration to a linear configuration;

said attachment means on said first end extending in a generally common direction with said attachment means on said second end thereby allowing said releasable attachment of said elongated bar in a linear configuration or a U-shaped configuration.

15. The toy mounting device of claim 13 wherein:

said elongated bar consists of a flexible material for changing the shape of said elongated bar from a linear configuration to an inverted U-shaped configuration.

16. The toy mounting device of claim 14 wherein:

said flexible material is cellular foam.

17. The toy mounting device of claim 15 wherein:

said flexible material is composed of a plastic material.

18. The toy mounting device of claim 11 wherein:

said attachment means consists of two suction cups.

19. The toy mounting device of claim 11 wherein said coupling member further includes:

a gap for releasing connection of said object.

20. The toy mounting device of claim 11 wherein said connecting ring includes:

a notch extending away from said elongated bar.

21. The toy mounting device of claim 20 wherein said suspension member further includes:

a complementary notch to said notch in said connecting ring, said complementary notch connected to said notch thereby placing said suspension member in a plane generally perpendicular to the plane of said connecting ring and parallel to said longitudinal axis of said elongated bar.

22. The toy mounting device of claim 11 wherein said suspension member further includes:

a gap for releasing connection with said object.

23. The toy mounting device of claim 11 wherein:

said object is an infant toy.

24. The toy mounting device of claim 11 wherein:

said object comprises a hollow body forming a cavity for holding water therein and wherein water fills said cavity through an opening in said hollow body.

25. The toy mounting device of claim 24 wherein said hollow body includes:

at least one additional opening therein for discharging water from said hollow body.

26. Thy toy mounting device of claim 11 wherein:

said attachment means is adapted to form a releasable attachment with a bathtub wall.

* * * * *